United States Patent [19]

Yoshizawa

[11] 4,223,613

[45] Sep. 23, 1980

[54] SECTIONAL RACK

[75] Inventor: Keiichi Yoshizawa, Chiba, Japan

[73] Assignee: TDK Electronics Co., Ltd., Tokyo, Japan

[21] Appl. No.: 973,050

[22] Filed: Dec. 26, 1978

[30] Foreign Application Priority Data

Jun. 9, 1978 [JP] Japan ..... 53-78059[U]

[51] Int. Cl.[2] ..... A47B 47/00

[52] U.S. Cl. ..... 108/64; 108/102; 108/91; 312/108

[58] Field of Search ..... 108/102, 103, 64, 91, 108/114; 248/167, 282; 211/169; 312/201, 108

[56] References Cited

U.S. PATENT DOCUMENTS

| | | | |
|---|---|---|---|
| 440,554 | 11/1890 | Fisher | 248/167 X |
| 576,815 | 2/1897 | Grant, Jr. | 248/167 X |
| 898,572 | 9/1908 | Gerhard | 248/282 |
| 1,303,985 | 5/1919 | Straubel | 108/102 |
| 2,251,737 | 8/1941 | Johnson | 108/102 |
| 3,690,610 | 9/1972 | Peirce | 108/101 |

FOREIGN PATENT DOCUMENTS

| | | | |
|---|---|---|---|
| 623607 | 3/1927 | France | 108/64 |
| 2230156 | 12/1974 | France | 108/64 |

*Primary Examiner*—Francis K. Zugel

*Attorney, Agent, or Firm*—Seidel, Gonda, Goldhammer & Panitch

[57] ABSTRACT

A sectional rack comprises a plurality of modular rack units for holding articles, and pivotal joint means for connecting the rack units together so that the units can pivotally swing relative to one another. Each of the rack units comprises oblong top and bottom plates having holes in both end portions, a post for connecting the two plates together by fitting at both ends in the holes of the plates, and top and bottom fasteners for securing and fastening the post to the plates. The pivotal joint means comprises oblong top and bottom connecting plates having pivot holes formed in both end portions, stepped posts having their ends extending into the pivot holes of the two connecting plates to connect them pivotally to the top and bottom plates of the rack units, and top and bottom fasteners for securing and fastening the posts to the top and bottom plates of the rack units. The top fasteners have a recess each and the bottom fasteners a projection each adapted to mate with the recess.

2 Claims, 11 Drawing Figures

SECTIONAL RACK

BACKGROUND OF THE INVENTION

This invention relates to a sectional rack which can be arranged in various modes with ease of assembly and disassembly and is suited for holding articles, especially video or audio cassettes or books.

Heretofore, the articles such as casettes have been kept in boxlike containers of the bookcase type. Those containers usually have such large standard capacities that, when they hold limited numbers of cassettes or books, the remainders, often most, of the spaces are left unoccupied. This is very inefficient and wasteful of space. Moreover, with the fixed boxlike construction, they cannot be freely changed in shape and are often limited in use because of their inability of being placed in desired location in adequate way according to need.

It is therefore a principal object of this invention to provide a rack which consists of sections or modular units which can be joined or stacked to produce a capacity just enough for accommodating the cassettes or books in the possession of the user.

Another object of the invention is to provide a sectional rack which can be changed in the mode of arrangement as desired according to the space or place where it is to be used or to suit the taste of the owner.

A further object of the invention is to provide a rack which can be assembled and disassembled in a simple way, so that it can be packed to smaller dimensions for transport, with less space requirement and reduced packing and shipping expenses.

SUMMARY OF THE INVENTION

To achieve the foregoing objects, the sectional rack of the present invention comprises a plurality of modular rack units for holding articles and pivotal joint means for connecting the rack units together in such a manner that the rack units can pivotally swing relative to one another.

In a preferred embodiment of the present invention the modular rack unit comprises an oblong top plate having connection holes formed in both longitudinal end portions thereof, an oblong bottom plate having connection holes coaxially aligned to the holes of the top plate in both longitudinal end portions thereof, a post for connecting the top and bottom plates together by fitting each end into one of the connection holes of the top and bottom plates, and a top fastener and a bottom fastener for securing and fastening the post to the top and bottom plates. Furthermore, in a preferred embodiment of the present invention the pivotal joint means comprises an oblong top connecting plate having pivot holes formed in both longitudinal end portions thereof, an oblong bottom connecting plate having pivot holes coaxially aligned to the pivot holes of the top connecting plate formed in both longitudinal end portions thereof, stepped posts having their ends extending into the pivot holes of the top and bottom connecting plates to connect both connecting plates pivotally to the top and bottom plates of the rack units, and top and bottom fasteners for securing and fastening the both ends of the stepped posts into the associated connection holes of the top and bottom plates of the rack units. Still further, the top fasteners of the modular rack units and of the pivotal joint means are formed with a recess and the bottom fasteners of the rack units and of the pivotal joint means each have a projection each adapted to mate with the recess.

The rack according to the present invention can be changed in capacity to meet specific space requirements and can be varied in the mode of arrangement according to the location where it is to be used or to suit the taste of the owner. Another advantage is the extreme ease with which it can be assembled and disassembled whenever the need arises.

BRIEF DESCRIPTION OF THE DRAWINGS

These and other objects and advantages of the invention will be more clearly understood from the following description taken in conjunction with the accompanying drawings showing embodiments thereof. In the drawings.

DESCRIPTION OF THE PREFERRED EMBODIMENTS

Figure 1:
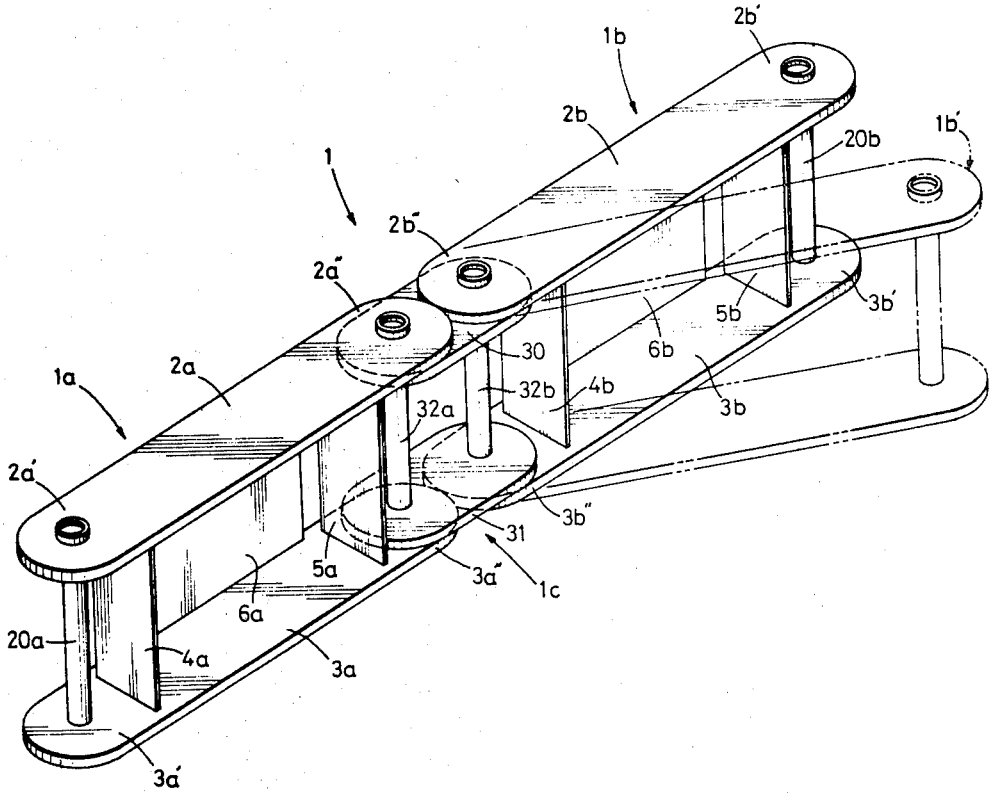
FIG. 1 is a perspective view of a rack embodying the invention as comprised of two modular rack units and pivotal joint means.

Referring to the drawings, specifically to FIG. 1, there is shown a rack 1 according to the invention as comprising a pair of modular rack units 1*a*, 1*b* and a pivotal joint means 1*c* for connecting the two rack units swingably relative to each other. This rack 1 is changeable in the mode of arrangement, for example, by swinging the rack unit 1*b* pivotally frontward around the joint means 1*c* to the position shown, as indicated by a phantom outline 1*b*'. Thus, the combination of rack units 1*a*, 1*b* can be arranged in many different ways according to the available space where it is placed or to meet the taste of the owner, as for example illustrated in FIG. 3. Since the rack units 1*a*, 1*b* are identically constructed and symmetrically disposed on opposite ends of the pivotal joint means 1*c*, only the unit 1*a* will be hereinafter described in detail. It will be appreciated that the same applies to the other unit 1*b*.

Figure 2:
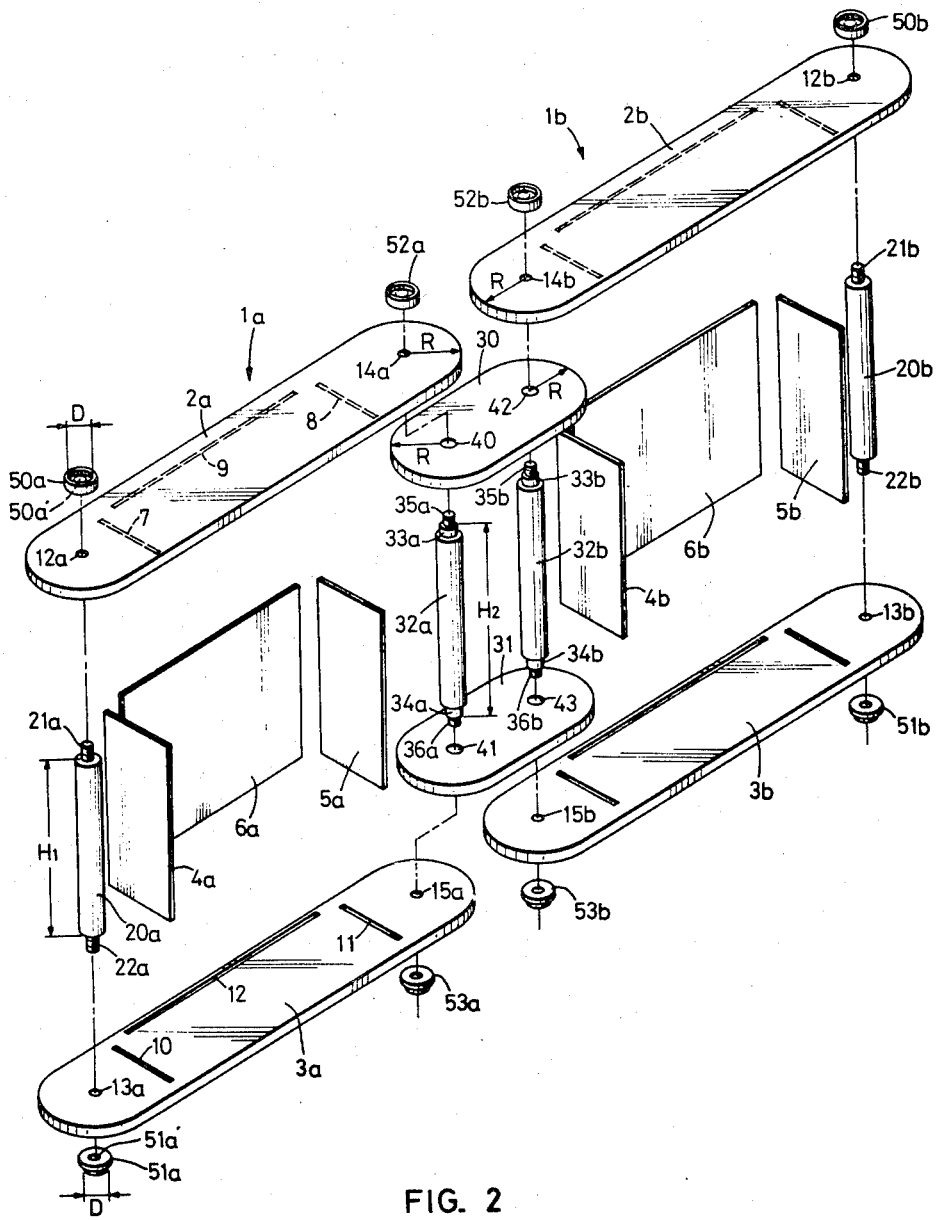
FIG. 2 is an exploded perspective view of the rack shown in FIG. 1.
Figure 3A:
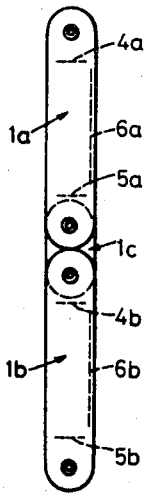
FIGS. 3(*a*) to (*g*) are schematic plan views of the racks in varied modes of arrangement.
Figure 3B:
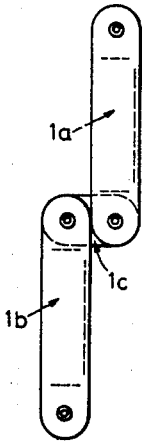
Figure 3C:
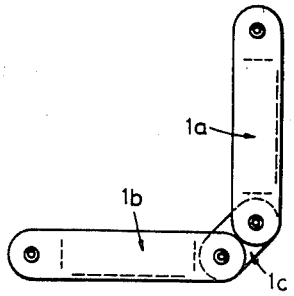
Figure 3D:
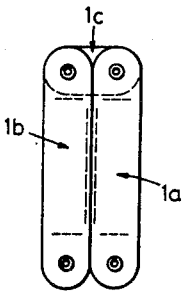
Figure 3E:
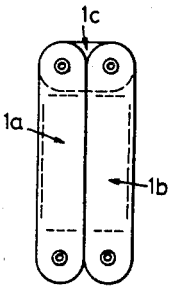
Figure 3F:
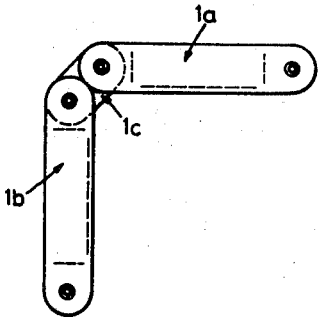
Figure 3G:
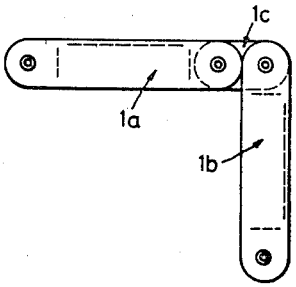

As will be obvious from FIG. 1 and also from FIG. 2 which is an exploded perspective view of the rack 1, the rack unit 1*a* comprises a top plate 2*a* and a bottom plate 3*a*, both of an oblong contour, and left and right side plates 4*a*, 5*a* and a back plate 6*a* to be held upright between the top and bottom plates. The both side plates 4*a*, 5*a* and the back plate 6*a* are fitted at both ends in elongate grooves 7, 8, 9 and 10, 11, 12 formed, respectively, in the top plate 2*a* and the bottom plate 3*a*. The top and bottom plates, in turn, have connection holes 12*a*, 13*a*, respectively, formed in the left end portions as viewed in FIG. 2 to receive both threaded smaller-diameter ends 21*a*, 22*a* of a post 20*a*. The threaded ends 21*a*, 22*a* extend through the holes 12*a*, 13*a* of the top and bottom plates 2*a*, 3*a* to mesh with a nutlike top fastener 50*a* having a threaded hole 50*a*' and a bottom fastener 51*a* having a threaded hole 51*a*'. In this way the top plate 2*a* and the bottom plate 3*a* are securely fastened together with the both side plates 4*a*, 5*a* and the back plate 6*a* in between. On the other, or right, end portions of the top and bottom plates, desirably semicircular-shaped with a radius R, there is provided a pivotal joint means 1c.

The pivotal joint means 1c comprises a pivotally swingable top connecting plate 30 and a bottom connecting plate 31 of the same shape and structure as the top plate 30. Like the top and bottom plates 2a, 3a, the connecting plates 30, 31 are rounded, that is, semicircular-shaped with a radius R at the both ends. In the centers of the semicircular end portions are formed pivot holes 40, 42 and 41, 43 spaced apart a distance of at least 2R each. Smaller diameter end parts or necks 33a, 34a of a stepped post 32a are inserted in the holes 40, 41 of the top and bottom connecting plates 30, 31. In order that those connecting plates may swing pivotally around the necks 33a, 34a, their holes 40, 41 are made slightly larger in diameter. Also, the length of the necks 33a, 34a is desirably equal to or less than the thickness of the connecting plates 30, 31. With the construction described, the pivotal joint means and each combination of rack units, as arranged in FIG. 3, can be fixedly joined by tightening upper and lower fasteners to be described later. The length $H_2$ of the stepped post, as measured between the outer extremities of the necks 33a, 34a, is equal to the length $H_1$ of the post 20a exclusive of its smaller-diameter threaded ends. The necks 33a, 34a of the stepped post 32a have further coaxial extensions in the form of threaded ends 35a, 36a of an even smaller diameter. Those threaded ends are inserted through holes 14a, 15a of the top and bottom plates 2a, 3a and are engaged, outside of the plates, with nutlike top and bottom fasteners 52a, 53a of the same structure as the fasteners 50a, 51a already described, so that the stepped post 32a is securely joined to the top plate 2a and the bottom plate 3a. From the foregoing description it will be understood that the connecting plates 30, 31 are now pivotally secured between the stepped post 32a and the top and bottom plates 2a, 3a. Similarly, a stepped post 32b on the opposite end of the pivotal joint means 1c is made just like the stepped post 32a. Its smaller-diameter necks 33b, 34b are pivotally inserted through pivot holes 42, 43 of the connecting plates 30, 31, and its threaded ends 35b, 36b of an even smaller diameter are inserted through holes 14b, 15b at the left end of a rack unit 1b made and assembled in the same fashion as the unit 1a. The threaded ends are then meshed with a top fastener 52b of the same structure as the top fastener 52a and with a bottom fastener 53b like the fastener 52a, and are tightened so that the pivotal joint means 1c is pivotally connected to the rack unit 1b. Thus, the rack units 1a, 1b are assembled with the pivotal joint means 1c in such a manner that the units can pivotally swing relative to each other.

FIGS. 3(*a*) through (*g*) represent various modes of arrangement in which the rack 1 consisting of the rack units 1a, 1b pivotally connected by the pivotal joint means 1c, can be placed according to the location where it is to be placed or to suit the taste of the owner. When the rack is arranged in the manner shown in (e), for example, the articles held in it are completely enclosed with the side plates and back plates.

Although the rack 1 has been described as comprising a pair of rack units connected by a single pivotal joint means 1c, it will be obvious to those skilled in the art that, if desired, three or more units instead may be connected with two or more pivotal joint means in a chain-like fashion.

An additional feature of the invention is that a plurality of the racks can be used according to necessity by stacking in tiers.

Referring to FIG. 2, the top fasteners 50a, 52a, 50b, and 52b have a recess having a diameter D at its upper surface, and the bottom fasteners 51a, 53a, 51b, and 53b have a downward projection on its underside each having a diameter D. The relation between the diameter D of each recess and the diameter D of each projection is such that the projection fits closely in the recess. Naturally the recess is desired to have a depth greater than the height of the projection. With the top and bottom fasteners made in the manner described, two racks, each as shown in FIG. 1, can be placed one upon another as in FIG. 4, by fitting the downward projections of bottom fasteners 51a', 53a', 53b', 51b' of an upper rack II in the recesses of top fasteners 50a, 52a, 52b, 50b of a lower rack I. Of course, while FIG. 4 shows two racks placed one upon another, more racks may be stacked if desired in a suitable number of tiers.

Figure 4:
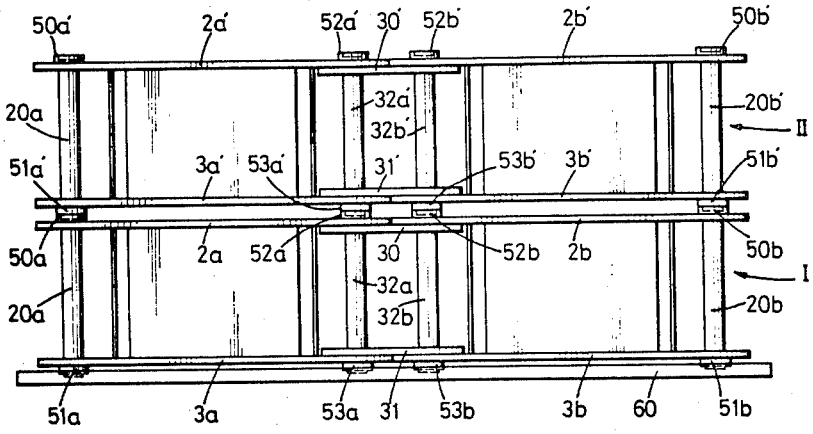
FIG. 4 is a front view of two racks, each as shown in FIG. 1, placed one upon another.
Figure 5:
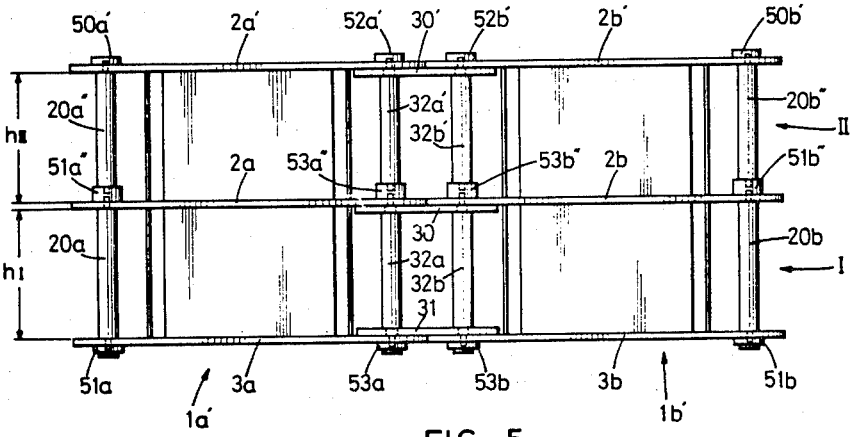
FIG. 5 is a front view of another embodiment of the invention which is generally similar to the rack of FIG. 1 but the rack units are of double construction.

When such racks are to be stacked in several tiers and in a straight-line arrangement as in FIG. 3(*a*), a base plate 60 of a suitable width, having adequate recesses formed on the upper surface to receive the bottom fasteners 51a, 53a, 53b, 51b of the lowermost rack I, may be placed under the rack I to provide stability to the whole rack assembly. (Refer to FIG. 4.)

Where a rack assembly of multiple tiers is an initial requirement, one as illustrated in FIG. 5 may be employed in place of the stack of separated racks I, II of FIG. 4. Thus, in contrast to the modular rack units 1a, 1b shown in FIG. 1 which are built in single-tiers the units 1a', 1b', in FIG. 5 are of a double-tier construction. Briefly, in this case, the bottom plates 3a', 3b' of the upper rack unit II and the pivotal connecting plate 31' in FIG. 4 can be omitted. In order to equalize the heights $h_I$, $h_{II}$ of the rack units I, II, intermediate fasteners 51a'', 53a'', 53b'', 51b'', posts 20a'', 20b'', and stepped posts 32a', 32b' are provided. The four intermediate fasteners are formed with threaded blind holes on both sides to engage threaded ends of the posts 20a, 20a'', stepped posts 32a, 32a', 32b, 32b', and posts 20b, 20b''. In addition, as will be clear from FIG. 5, the posts 20a'', 20b'' are made shorter than the posts 20a, 20b by the thickness of the intermediate fasteners 51a'', 51b'', and, unlike the stepped posts 32a, 32b, the stepped posts 32a', 32b' are not provided with the lower necks 34a, 34b (FIG. 2) of the posts 32a, 32b. It will be understood, of course, that the upper ends of the stepped posts 32a', 32b' are made in the same way as the stepped posts 32a, 32b.

With the construction so far described, the rack according to this invention can be changed in capacity to meet specific space requirements and can be varied in the mode of arrangement according to the location where it is to be used or to suit the taste of the owner. Another advantage is the extreme ease with which it can be assembled and disassembled whenever the need arises.

While preferred embodiments of the invention have been described using specific terms, such description is for illustrative purposes only, and it is to be understood that changes and variation may be made without departing from the spirit or scope of the following claims.

What is claimed is:

1. A sectional rack comprising a plurality of modular rack units for holding articles and pivotal joint means for connecting said rack units together in such a manner that said rack units can pivotally swing relative to one another; said modular rack unit comprising an oblong top plate having connection holes formed in both longitudinal end portions thereof, an oblong bottom plate having connection holes coaxially aligned to the holes of said top plate in both longitudinal end portions thereof, a post for connecting said top and bottom plates together by fitting each end into one of the connection holes of said top and bottom plates, and a top and a bottom fastener for securing and fastening said post to said top and bottom plates; and said pivotal joint means comprising an oblong top connecting plate having pivot holes formed in both longitudinal end portions thereof, an oblong bottom connecting plate having pivot holes coaxially aligned to the pivot holes of said top connecting plate formed in both longitudinal end portions thereof, stepped posts having their ends extending into said pivot holes of said top and bottom connecting plates to connect said top and bottom connecting plates pivotally to said top and bottom plates of said rack units, and a top and a bottom fastener for securing and fastening each end of said stepped posts into the associated holes of said top and bottom plates of said rack units, said top fasteners of said modular rack units and of said pivotal joint means being formed with a recess and said bottom fasteners of said rack units and of said pivotal joint means each having a projection adapted to mate with said recess.

2. A sectional rack according to claim 1, having means defining an enclosure including left and right side plates and a back plate extending between said top and bottom plates.

* * * * *